United States Patent [19]

Brosius et al.

[11] Patent Number: 4,748,059

[45] Date of Patent: May 31, 1988

[54] ASSEMBLY FOR PRODUCING EXTRUSION-CLAD TUBULAR PRODUCT

[75] Inventors: Karl S. Brosius, Burgettstown; Scott B. Justus, Wexford; David A. Salvatora, Gibsonia, all of Pa.

[73] Assignee: Crucible Materials Corporation, Pittsburgh, Pa.

[21] Appl. No.: 925,988

[22] Filed: Nov. 3, 1986

Related U.S. Application Data

[62] Division of Ser. No. 788,416, Oct. 17, 1985, Pat. No. 4,640,815.

[51] Int. Cl.[4] ..... B27N 5/02

[52] U.S. Cl. ..... 428/35; 428/188; 428/542.8; 419/8; 419/9; 419/41; 419/67

[58] Field of Search ..... 419/8, 9, 41, 67; 428/35, 188, 554, 542.8, 553, 558

[56] References Cited

U.S. PATENT DOCUMENTS

| | | | |
|---|---|---|---|
| 3,982,904 | 9/1976 | Nayar | 428/588 |
| 4,069,042 | 1/1978 | Buchovecky et al. | 419/8 |
| 4,090,873 | 5/1978 | Takamura et al. | 419/8 |
| 4,478,787 | 10/1984 | Nadkarni et al. | 419/8 |
| 4,584,170 | 4/1986 | Aslund et al. | 428/588 |
| 4,606,883 | 8/1986 | Wizemann et al. | 419/8 |
| 4,627,958 | 12/1986 | Hays | 419/8 |
| 4,640,814 | 2/1987 | Haswell et al. | 419/8 |
| 4,640,815 | 2/1987 | Brosius et al. | 419/8 |

*Primary Examiner*—Stephen J. Lechert, Jr.
*Attorney, Agent, or Firm*—Finnegan, Henderson, Farabow, Garrett & Dunner

[57] ABSTRACT

A powder-metallurgy method and assembly for producing tubular product having at least one surface and preferably an interior surface thereof clad with an alloy different from and preferably more resistant to destructive media than the material from which the remainder of the tubing is constructed. An assembly is constructed of a metal tubing having an internal surface to be clad and a tubular insert mounted generally axially within the tubing in spaced-apart relation to the internal surface thereof, which provides a generally annular cavity between the internal surface of the tubing and the tubular insert. This cavity is filled with metal particles of a composition to be clad on the tubing internal surface. The cavity is sealed and the assembly is heated to an elevated temperature at which it is extruded to compact metal particles introduced to the cavity to substantially full density and metallurgically bond the particles to the internal surface to provide a desired destructive-media resistant cladding.

6 Claims, 1 Drawing Sheet

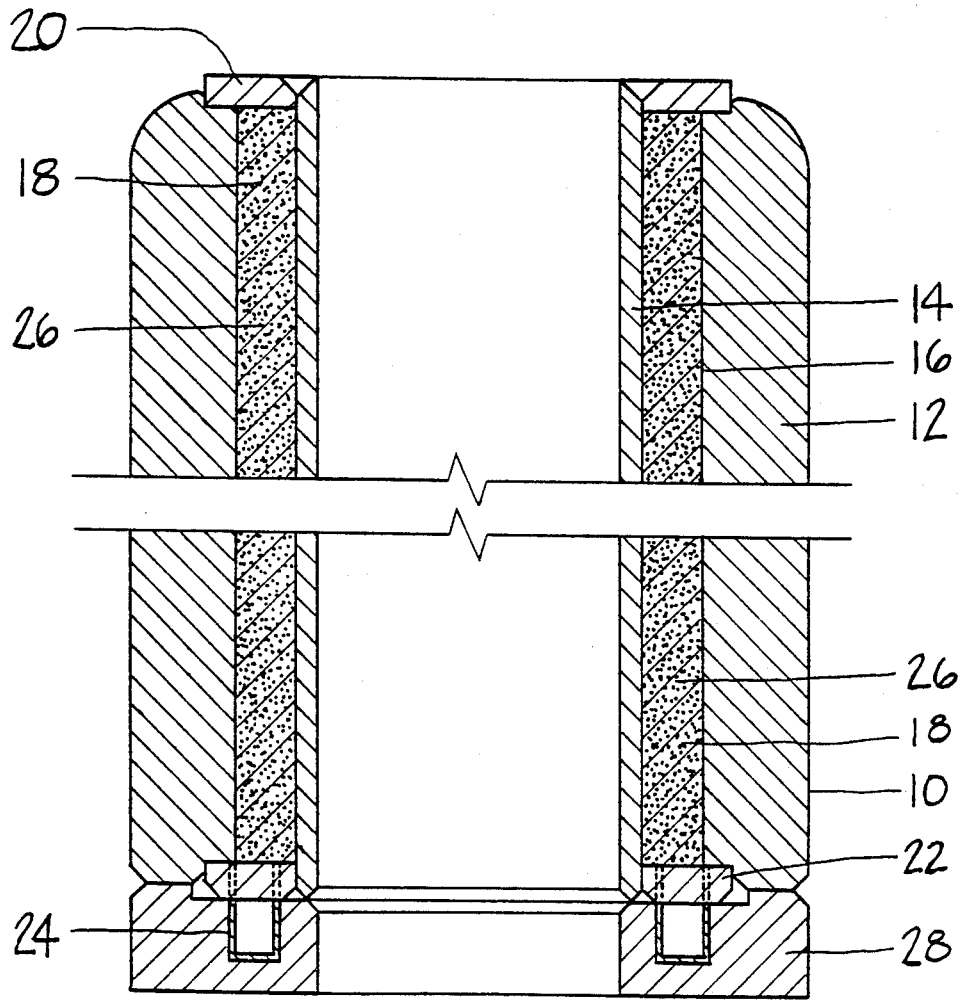
20
18
26
14
16
12
26
18
10
22
24
28

ASSEMBLY FOR PRODUCING EXTRUSION-CLAD TUBULAR PRODUCT

This is a division of application Ser. No. 788,416, filed Oct. 17, 1985 U.S. Pat. No. 4,640,815.

BACKGROUND OF THE INVENTION

In applications, such as oil well drilling, the petrochemical industry and geothermal installations, there is a need for tubing that is highly resistant to the destructive media of substances flowing through the tubing. This destructive media, depending upon the particular application, may include corrosive media, abrasive media, high-temperature media and combinations thereof. For these applications it is known to use monolithic tubing of alloys that are highly resistant to destructive media, which would include nickel-base alloys such as INCO 625. With monolithic tubing constructed from conventional alloys of this type, the cost of the finished tubing is typically on the order of $50 per foot, and the cost may be much higher for large-diameter tubing. This adds considerably to the overall cost of installations with which tubing of this type is employed.

SUMMARY OF THE INVENTION

It is accordingly a primary object of the present invention to provide a method and assembly for producing tubular product having at least one clad surface, and preferably an interior surface, of a conventional alloy different from and preferably resistant to destructive media with the remainder of the tubing being constructed from a different material that is preferably less resistant to destructive media, and thus a lower cost material; in this manner, tubing suitable for use in applications embodying destructive media may be produced at a much lower cost than using monolithic tubing of the required destructive-media resistant alloy.

A more specific object of the invention is to provide a method and assembly for producing internally clad tubing suitable for use in destructive-media applications wherein internal cladding is provided by a powder-metallurgy practice wherein metal particles of the desired destructive-media resistant alloy are used to clad the internal surface of the tubing by extrusion to compact the metal particles to substantially full density and metallurgically bond them to the internal surface of the tubing.

In accordance with these objects, and broadly in accordance with the invention, the method thereof for producing tubular product having on at least one surface thereof, and preferably an internal surface, cladding of an alloy different from and preferably more resistant to destructive-media than the interior surface to be clad comprises constructing an assembly including a metal tubing having an internal surface to be clad, a tubular insert mounted generally axially within said tubing in spaced-apart relation to the internal surface thereof to provide a generally annular cavity between said internal surface and said tubular insert. This cavity is filled with metal particles of a composition different from and preferably more resistant to the destructive-media than the surface to be clad or the remainder of the tubing. The assembly is heated to an elevated temperature and extruded to compact the metal particles to substantially full density and metallurgically bond the particles to the internal surface, whereby cladding is produced on the surface of the tubing, and preferably on an internal surface. During the extrusion operation, the metal tubing is elongated. The assembly may include for sealing the powder-filled cavity, two annular rings each connected in sealing engagement between adjacent ends of the tubing and the tubular insert at opposite ends of the assembly. The cavity may be filled with metal particles through at least one stem that extends into the annular cavity. The stem is adapted for sealing prior to extruding. The stem may extend through one of the annular rings and, after filling the annular cavity with metal particles and prior to extruding, the cavity is sea ed by crimping the stem and connecting an annular cap in sealing engagement between adjacent ends of the tubing and the insert and over the crimped stem.

BRIEF DESCRIPTION OF THE DRAWING

The single Figure of the drawing is a sectional view of one embodiment of an assembly in accordance with the invention and suitable for use in the method of the invention for producing a metal tubular product having an internal surface clad with an alloy of a metallurgical composition different than the surface being clad or the remainder of the tubing.

DETAILED DESCRIPTION OF THE INVENTION

With reference to the drawing, there is shown an assembly in accordance with the invention and suitable for use in the practice of the method thereof. The assembly, generally designated as 10, includes a tubing 12, which may be of an alloy that is less resistant to destructive media than required for a particular application. Typically, the tubing may be low-alloy steel or plain carbon steel. The only requirement with regard to the material from which the tubing is constructed is that it be extrudable. Positioned generally axially within said tubing 12 and having a diameter less than the internal diameter of the tubing 12 is a tubular insert 14. The tubular insert 14 may be constructed from the same material as the tubing 12, but this is not a requirement. The insert 14, as shown in the Figure, is in spaced-apart relation from internal surface 16 of the tubing 12. The area between insert 14 and internal surface 16 of tubing 12 constitutes an annular cavity 18. An annular metal ring 20 is connected in sealing engagement, as by welding (not shown), between adjacent ends of the tubing 12 and insert 14 at one end of the assembly 10. The annular ring 20 in this manner seals the end of the cavity 18 at which it is connected. At the opposite end of the cavity 18 from the ring 20 there is provided a second annular ring 22 that is similarly connected in sealing engagement between adjacent ends of the tubing and the tubular insert. The annular rings 20 and 22 are constructed of metal which may be the same as that of insert 14. Two identical metal stems 24 extend into the cavity 18. Metal particles, designated as 26, are introduced to the cavity 18 through stems 24. The metal particles are of a composition different than the tubing surface to be clad, and preferably of a material that is more resistant to destructive media than the material of the surface to be clad. Although two stems are shown for this purpose in the Figure, any suitable number may be employed. The stems 24 extend through annular ring 22. After filling the annular cavity 18 with metal particles 26 introduced through the stems 24, the stems are crimped, which is the configuration shown in the Figure, and an annular cap 28 is connected in sealing engagement between adjacent ends of the tubing and insert and over the crimped stems. The cap is connected as by welding (not shown) to tubing 12 and ring 22. In this manner, the end of the cavity 18 opposite that of ring 20 is likewise sealed after filling of the cavity with the metal particles 26.

The assembly 10 after filling of the cavity 18 thereof with metal particles and sealed as shown in the drawing, is heated to a temperature for extrusion which temperature is typically within the range of 950 to 2400° F. The assembly is then extruded by any of the well known, conventional practices used for this purpose. During extrusion the particles 26 are compacted to essentially full density and metallurgically bonded to the surface 16 of the tubing 12. Also during extrusion, and incident to this compacting and bonding operation, the tubing is elongated about 300 to 3000%.

After extrusion the annular rings 20 and 22 and cap 28 may be removed to provide a tubing having the desired interior clad surface. Likewise, insert 14 may be removed by a machining operation which may be chemical or mechanical or by a combination of chemical and mechanical action. There may be applications wherein the insert may remain on the compacted tubing. The insert is bonded to the compacted particles 26 during the extrusion operation.

The metal particles 26 may be produced by any of the well known practices for manufacturing powder particles suitable for powder-metallurgy applications. One preferred practice, however, is to gas atomize a molten metal stream to produce discrete prealloyed particles which are rapidly cooled within a protective atmosphere and collected for use.

It is to be understood that the term "metal" as used in the specification and claims includes alloys as well as carbides, such as tungsten carbides and the like and the terms "metal" and "alloy" are used in interchangably. The metal particles in applications requiring resistance to a highly abrasive media may be particles of carbides, such as tungsten carbides, which are highly resistant to abrasion.

Although the invention has been described and claimed with respect to cladding "tubing", it is to be understood that various cylindrical products could be made by the practice of the invention which might be used in other than tubing applications.

Prior to extrusion and incident to the heating operation of the assembly, the cavity 18 of the assembly may be connected through stems 24 to a pump which may be used to evacuate the chamber interior to remove deleterious gaseous-reaction products prior to sealing the cavity, which operation is conventionally termed "outgassing."

SPECIFIC EXAMPLE

To demonstrate the invention, an assembly in accordance with the invention for extrusion was produced substantially in accordance with the structure shown in the Figure. The tubing of the assembly had a length of about 3½ feet. The tubing was a low alloy steel of the specific composition, in percent by weight:

| C | Mn | P | S | Si | Cr | Ni | Mo | Ti | V | Cu | Fe |
|---|---|---|---|---|---|---|---|---|---|---|---|
| 0.16 | 0.34 | 0.13 | 0.004 | 0.28 | 1.59 | 3.0 | 0.46 | 0.01 | 2.01 | 0.25 | balance |

Also, the metal particles used for cladding were of the specific composition, in percent by weight:

| C | Mo | Mn | Si | S | P | Cr | Co |
|---|---|---|---|---|---|---|---|
| 0.013 | 9.02 | 0.20 | 0.11 | 0.004 | 0.003 | 21.10 | <0.05 |

| Fe | Cb | Ti | Al | Ni |
|---|---|---|---|---|
| 2.31 | 3.76 | 0.05 | 0.37 | balance |

The assembly was heated to a temperature of 500° F., out-gassed for about 3 hours and the assembly was then sealed as described herein. The sealed assembly was then heated to a temperature of 2150° F. and extruded on a horizontal 12,000-ton extrusion press. After extruding and disassembly, the particles were found to be essentially fully dense and metallurgically bonded to the interior surface of the tubing. An elongation of the tubing of 1580% resulted during the extrusion operation. The length of the tubing, after extrusion, was approximately 56 feet.

It has been determined in accordance with the invention that tubing lengths on the order of about 90 to 100 feet maximum may be readily clad with alloys resistant to destructive-media to result in production costs drastically less than the production cost of monolithic tubing constructed from the same material as used for cladding.

What is claimed is:

1. An assembly for use in producing metal tubing having an internal surface clad with a material of a metallurgical composition different from said internal surface, said assembly comprising a metal tubing having an internal surface to be clad, a hollow tubular metal insert mounted generally axially within said tubing in spaced-apart relation to said internal surface thereof to provide a generally annular cavity between said internal surface and said hollow tubular metal insert, means for filling said cavity with metal particles of a metallurgical composition different than said internal tubing surface and means for sealing said cavity, whereby said assembly is adapted for heating and extrusion to densify and metallurgically bond metal particles within said cavity to said internal surface of said tubing to clad the surface.

2. The assembly of claim 1 wherein said means for sealing said cavity includes two annular rings each connected in sealing engagement between adjacent ends of said tubing and said hollow tubular metal insert at opposite ends of said assembly.

3. The assembly of claim 1 wherein said means for filling said cavity with said metal particles includes at least one stem extending into said annular cavity.

4. The assembly of claim 2 wherein said means for sealing said cavity further includes an annular cap connected in sealing engagement between adjacent ends of said tubing and said hollow tubular metal insert and over said stem.

5. An assembly for use in producing metal tubing having an internal surface clad with a material of a metallurgical composition different from said metal surface, said assembly comprising a metal tubing having an internal surface to be clad, a hollow tubular metal insert mounted generally axially within said tubing in spaced-apart relation to said internal surface thereof to provide a generally annular cavity between said internal surface and said hollow tubular metal insert, at least one stem extending into said cavity and adapted for use in filling said cavity with metal particles of a metallurgical composition different than said internal tubing surface and means for sealing said cavity including two annular rings each connected in sealing engagement between adjacent ends of said tubing and said hollow tubular metal insert at opposite ends of said assembly.

6. The assembly of claim 5 wherein in said means for sealing said cavity further includes an annular cap connected in sealing engagement between adjacent ends of said tubing and said insert and over said stem.

* * * * *